US008037983B2

(12) United States Patent
Leung

(10) Patent No.: US 8,037,983 B2
(45) Date of Patent: Oct. 18, 2011

(54) LUGGAGE HAVING AN ANGULARLY RETRACTABLE HANDLE

(75) Inventor: Yu Kei Jackie Leung, New Territories (HK)

(73) Assignee: Twinkle Leatherware Co., Ltd., New Territories (HK)

( * ) Notice: Subject to any disclaimer, the term of this patent is extended or adjusted under 35 U.S.C. 154(b) by 671 days.

(21) Appl. No.: 11/936,055

(22) Filed: Nov. 6, 2007

(65) Prior Publication Data

US 2009/0114493 A1 May 7, 2009

(51) Int. Cl.
*A45C 13/26* (2006.01)

(52) U.S. Cl. ..... 190/18 A; 190/115; 16/113.1

(58) Field of Classification Search ..... 190/18 A, 190/115; 16/113.1
See application file for complete search history.

(56) References Cited

U.S. PATENT DOCUMENTS

| | | | | |
|---|---|---|---|---|
| 5,330,037 | A * | 7/1994 | Wang | 190/18 A |
| 5,615,757 | A * | 4/1997 | Chen | 190/115 |
| 6,533,086 | B1 * | 3/2003 | Waddell et al. | 190/18 A |
| 7,097,181 | B2 * | 8/2006 | Sadow | 280/37 |
| 2005/0173876 | A1 * | 8/2005 | Sadow | 280/37 |
| 2008/0308370 | A1 * | 12/2008 | Chung et al. | 190/18 A |

FOREIGN PATENT DOCUMENTS

| | | | |
|---|---|---|---|
| CN | 1181912 | A | 5/1998 |
| GB | 2 319 500 | A | 5/1998 |
| JP | 11309011 | | 11/1999 |
| WO | 03041529 | A1 | 5/2003 |

* cited by examiner

*Primary Examiner* — Tri Mai
(74) *Attorney, Agent, or Firm* — Bacon & Thomas, PLLC

(57) ABSTRACT

Luggage having an angularly retractable handle includes: a main body; a mounting plate, positioned at a front wall of the main body; a pivot, positioned at the mounting wall; an angularly retractable handle, connected to the mounting plate by the pivot, wherein the angularly retractable handle rotates with respect to the front wall of the main body via the pivot; a plurality of first wheel carriers, fixed on the bottom of the main body; a plurality of second wheel carriers, positioned on the bottom of the main body in a rotatable way; and at least four wheels, respectively assembled on the first wheel carriers and second wheel carriers.

5 Claims, 10 Drawing Sheets

LUGGAGE HAVING AN ANGULARLY RETRACTABLE HANDLE

BACKGROUND OF THE INVENTION

1. Field of the Invention

The invention relates to luggage, and more particularly, to wheeled luggage having an angularly retractable handle.

2. Description of the Prior Art

In a prior art wheeled luggage 100 as shown in FIG. 1, the wheeled luggage 100 comprises a pivot 120 utilized for connecting a handle 130 and a main body 110. As shown in FIG. 1, when towing the wheeled luggage 100, the bottom at one side of the main body 110 leaves the ground and wheels 140 at the front side of the wheeled luggage become a pivot of the main body 110. Therefore, the user needs to use more energy to maintain the main body 110 at inclined status. On the other hand, because the main body 110 is inclined when towing the wheeled luggage 100, a top wall 150 of the main body 110 is not horizontal and the objects placed on the top wall 150 may drop to the ground easily.

In another prior art wheeled luggage 200 as shown in FIG. 2, the wheeled luggage 200 comprises a pivot 220 utilized for connecting a handle 230 and a main body 210. As shown in FIG. 2, because the user does not need to maintain the wheeled luggage 200 at the inclined status as shown in FIG. 2, towing the wheeled luggage 200 is more comfortable than towing the wheeled luggage 100 mentioned above. However, when the user tows the wheeled luggage 200, the degree of comfort the user feels is determined by the position of the pivot 220. The position of the pivot 220 shown in FIG. 2 is close to the top wall 250 of the main body 210 and is not an ideal position. On the other hand, sometimes the user may have other baggage with great volume and may place it on the top wall 250 of the wheeled luggage 200, therefore how to design the wheeled luggage 200 to allow the user to conveniently place additional baggage or objects on the top wall of the wheeled luggage is an important topic for luggage design.

SUMMARY OF THE INVENTION

Therefore it is one of the objectives of the claimed invention to provide luggage having a pivot positioned below the center of the main body of the luggage, a slide arm, a slot, and wheels assembled on different wheel carriers, to solve the above-mentioned problems.

According to one embodiment of the claimed invention, the luggage comprises: a main body; a mounting plate positioned at a front wall of the main body; a pivot, positioned at the mounting wall; an angularly retractable handle, connected to the mounting plate by the pivot, wherein the angularly retractable handle rotates with respect to the front wall of the main body via the pivot; a plurality of first wheel carriers, fixedly positioned on a bottom wall of the main body; a plurality of second wheel carriers, positioned on the bottom wall of the main body in a way allowing multi-directional rolling; and at least four wheels, respectively assembled on the plurality of first wheel carriers and the plurality of second wheel carriers.

According to another embodiment of the claimed invention, the luggage comprises: a main body; a mounting plate, positioned at a front wall of the main body; a pivot, positioned at the mounting wall; an angularly retractable handle, connected to the mounting plate by the pivot, wherein the angularly retractable handle rotates with respect to the front wall of the main body via the pivot; a slide arm, for movably connecting the mounting plate and the angularly retractable handle to maintain a target angle between the angularly retractable handle and the front wall of the main body; and a slot, positioned on the mounting plate, for guiding the slide arm to slide thereon.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
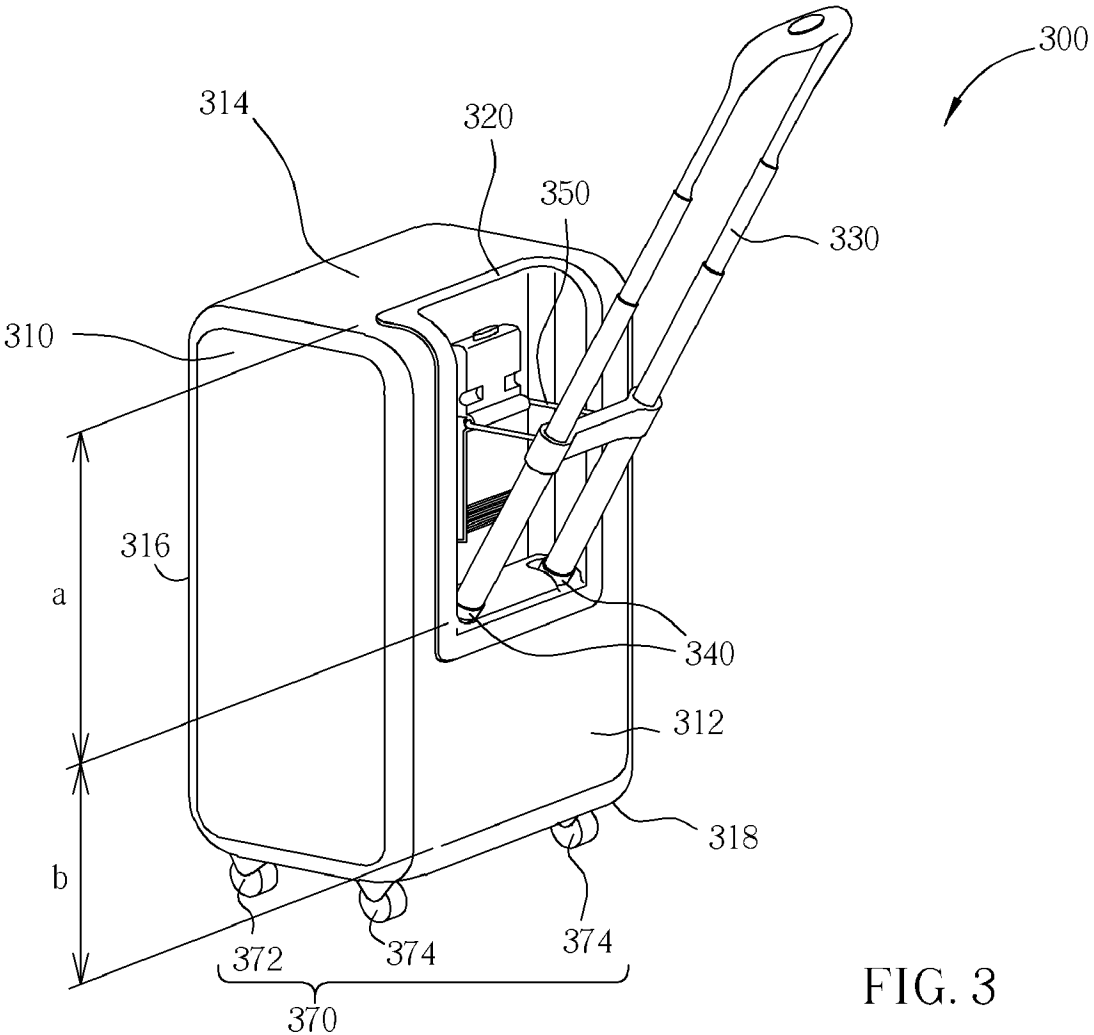
FIG. 3 is a perspective view of a piece of wheeled luggage according to one embodiment of the claimed invention.
Figure 6:
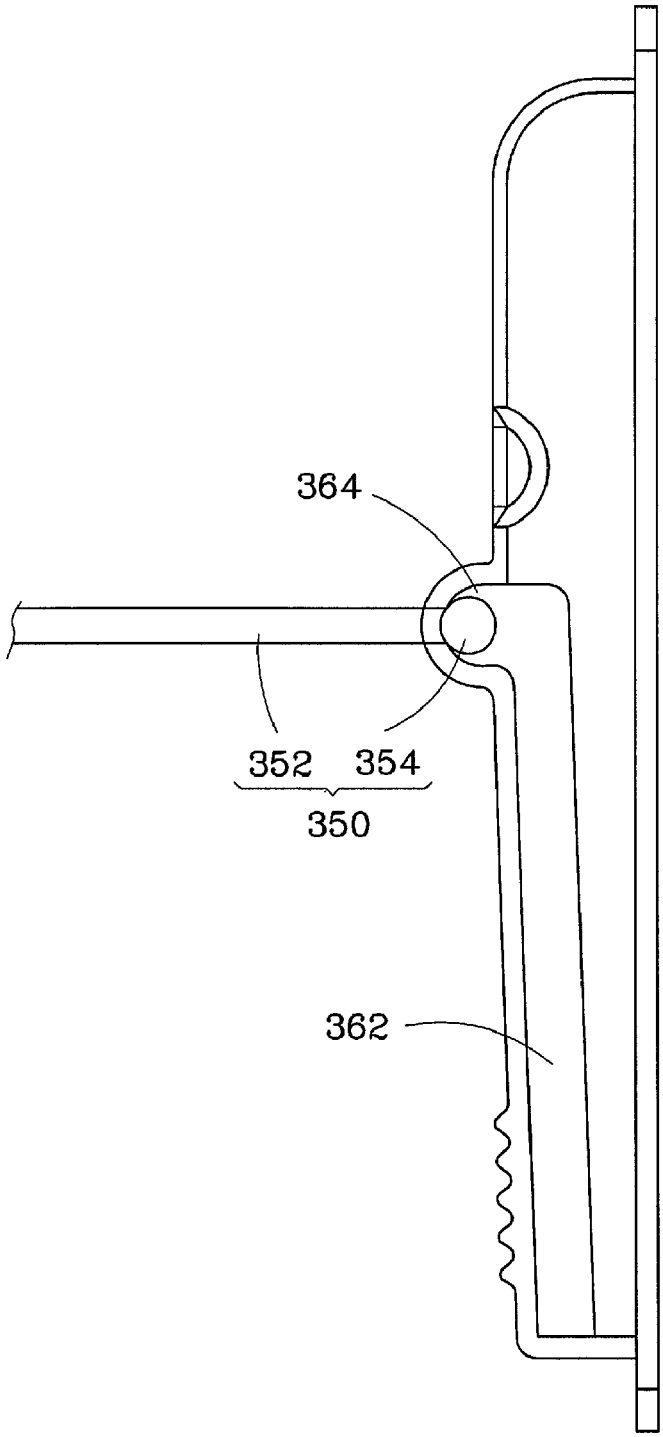
FIG. 6 is a side view of the slide arms and the slots when the angularly retractable handle is received by a mounting plate.

Please refer to FIG. 3. FIG. 3 is a perspective view of a piece of wheeled luggage 300 according to one embodiment of the present invention. The wheeled luggage 300 comprises, but is not limited to, a main body 310; a mounting plate 320, positioned at a front wall of the main body (please note that this term "front wall" stands for a wall facing the user when the luggage is moving), for receiving and retaining an angularly retractable handle 330; a pivot 340, positioned at the mounting plate 320, wherein a ratio between a distance between the pivot 340 and a top wall 314 of the main body 310 and a distance between the pivot 340 and a bottom wall 318 of the main body 310 is greater than eighty percents; the angularly retractable handle 330, connected to the mounting plate 320 by the pivot 340, wherein the angularly retractable handle 330 rotates with respect to the front wall 312 of the main body 310 via the pivot 340; at least a slide arm 350, for movably connecting the mounting plate 320 and the angularly retractable handle 330 to maintain a target angle between the angularly retractable handle 330 and the front wall 312 of the main body 310; at least a slot 360, positioned on the mounting plate 320, for guiding the slide arm 350 to slide thereon; and four wheels 370, where two wheels 372 assembled on wheels carriers 382 are fixedly positioned on a bottom wall of the main body, and the other two wheels 374 are assembled on wheel carriers positioned on a bottom wall of the main body in a rotatable way allowing multi-directional rolling; and the wheels 372 assembled on the wheel carriers 382 are close to the front wall 312 of the main body (that is, a wall facing the user when the luggage is moving), and the wheels 374 assembled on the wheel carriers 384 are close to the front wall 316 of the main body 310 (that is, a wall facing back to the user when the luggage is moving). As shown in FIG. 6, the slide arm 350 has two outer shaft portion 352 and one inner shaft portion 354. Each outer shaft portion 352 connects with the angularly retractable handle 330 with its one end. The inner shaft portion 354 connects between the other ends of the outer shaft portions 352, and is positioned in the slot 360.

In this embodiment, the length of the angularly retractable handle 330 is designed for towing the wheeled luggage 300 horizontally. Towing the wheeled luggage 300 horizontally means that the four wheels are rolling on the ground, and therefore the user will save energy and feel more comfortable.

Figure 1:
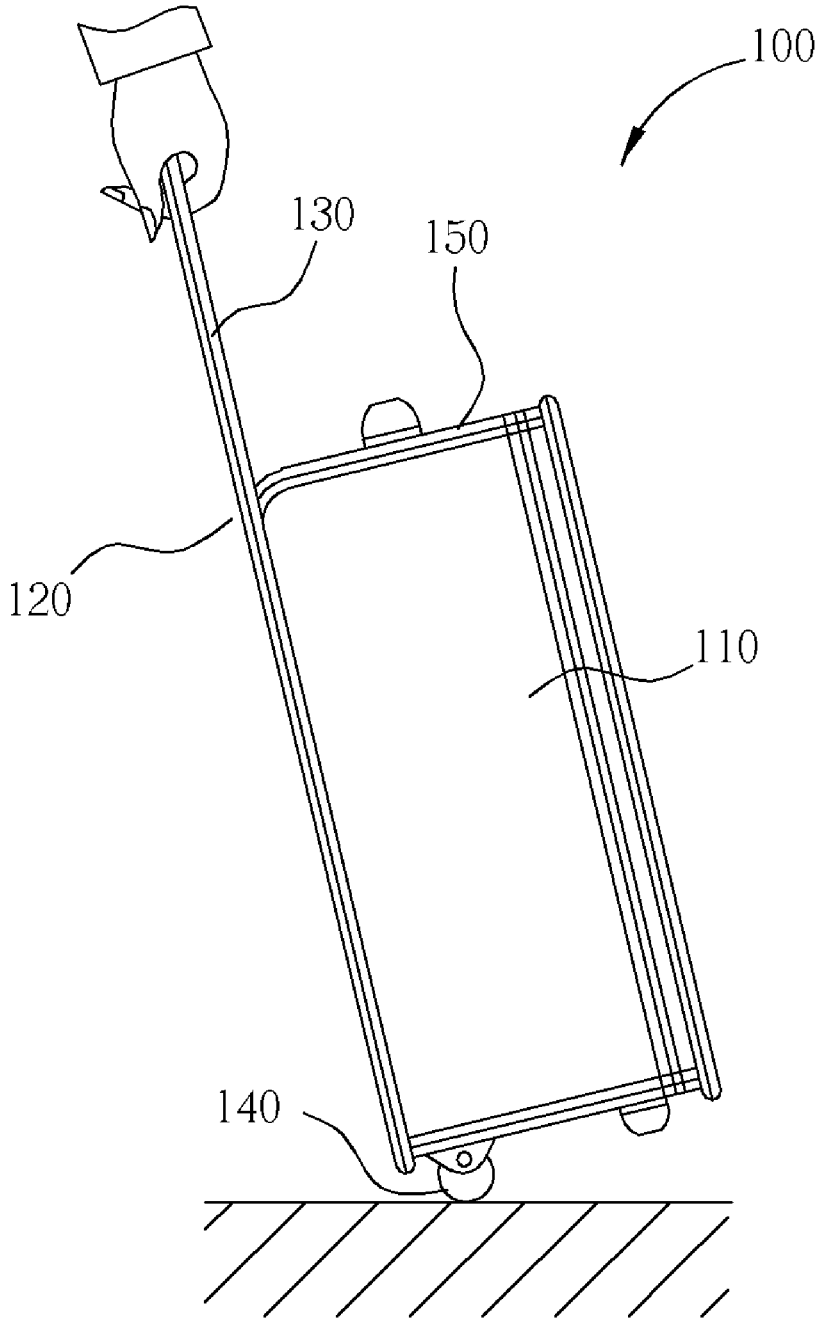
FIG. 1 PRIOR ART
FIG. 1 is a side elevation view of a first piece of conventional wheeled luggage.
Figure 2:
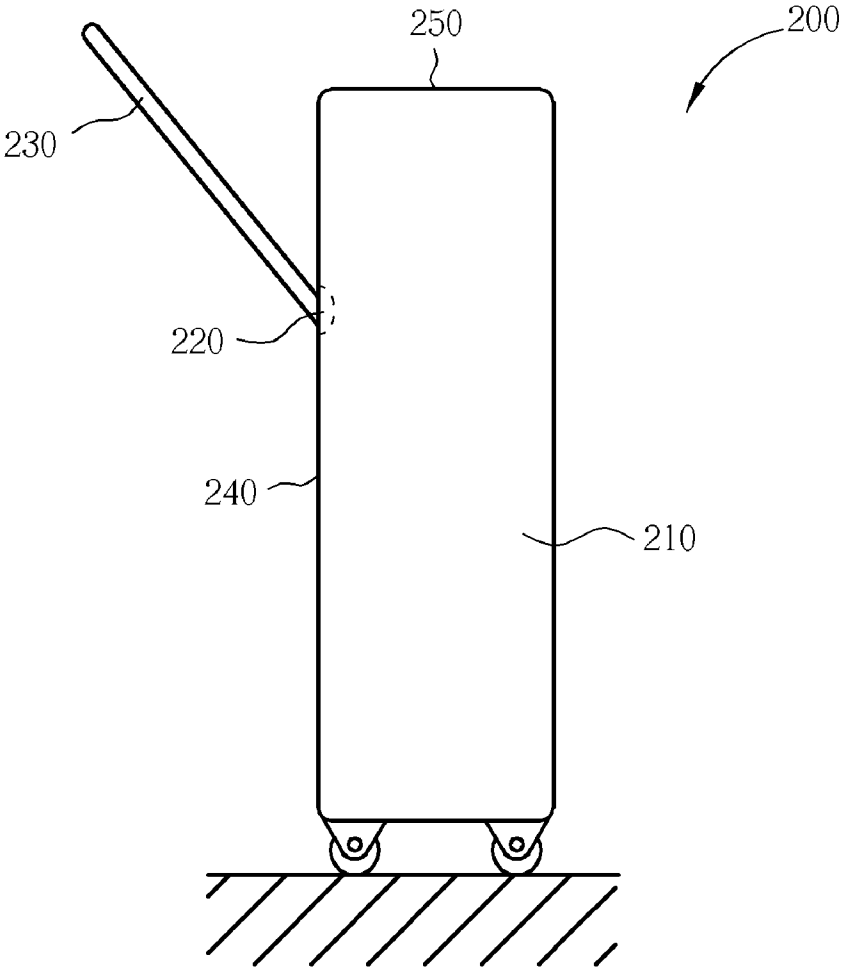
FIG. 2 PRIOR ART
FIG. 2 is a side elevation view of a second piece of conventional wheeled luggage.

In conventional luggage designs, the position of the pivot 220 shown in FIG. 2 is designed to be near to the top wall 250 of the wheeled luggage 200 or even at the corner between the top wall 250 and the front wall 240. In this embodiment of the present invention, the pivot 340 however is located at the position that a ratio between the distance between the pivot 340 and the top wall 314 of the main body 310 and a distance between the pivot 340 and the bottom wall 318 of the main body 310 is greater than eighty percents, that is the value of a/b shown in FIG. 3 is greater than 0.8. The lower position of the pivot 340 can effectively save the energy of the user when towing the wheeled luggage 300.

The above-mentioned ratio between the distance between the pivot 340 and the top wall 314 of the main body 310 and a distance between the pivot 340 and the bottom wall 318 of the main body 310 is an example. In practice, the mounting plate is a component with a fixed size. Therefore, for the luggage with different height (that is the distance between the top wall and the bottom wall of the main body), there is different ratio between the distance between the pivot 340 and the top wall 314 of the main body 310 and a distance between the pivot 340 and the bottom wall 318 of the main body 310. Taking a luggage with 22 inches height as an example, the ratio is around 160 percents.

However, for conveniently towing the wheeled luggage 300, the lower the position of the pivot 340, the longer the angularly retractable handle 330 to let the user comfortably hold the angularly retractable handle 330. Additionally, the slide arm 350 is implemented to serve as a supporting device to provide support between the angularly retractable handle 330 and the main body 310. The longer the angularly retractable handle 330, the weaker the angularly retractable handle 330 and the pivot 340 when the user tows the wheeled luggage 300. Therefore, the slide arm 350 serving as the supporting device is more important here.

Additionally, because the mounting plate is a component with a fixed size. The greater the luggage size, the higher position of the pivot 340, and therefore the shorter the angularly retractable handle 330 is required for the user can tow the wheeled luggage 300 conveniently. Regarding the design of the angularly retractable handle 330, for the luggage with different sizes, the length of the angularly retractable handle 330 is determined according to the length which people tows the luggage most conveniently, that is this optimal length of the angularly retractable handle 330 is determined by experiments. Additionally, because every user has a different preferred length of the angularly retractable handle 330, the angularly retractable handle 330 can change its length by retracting the handle.

Figure 4:
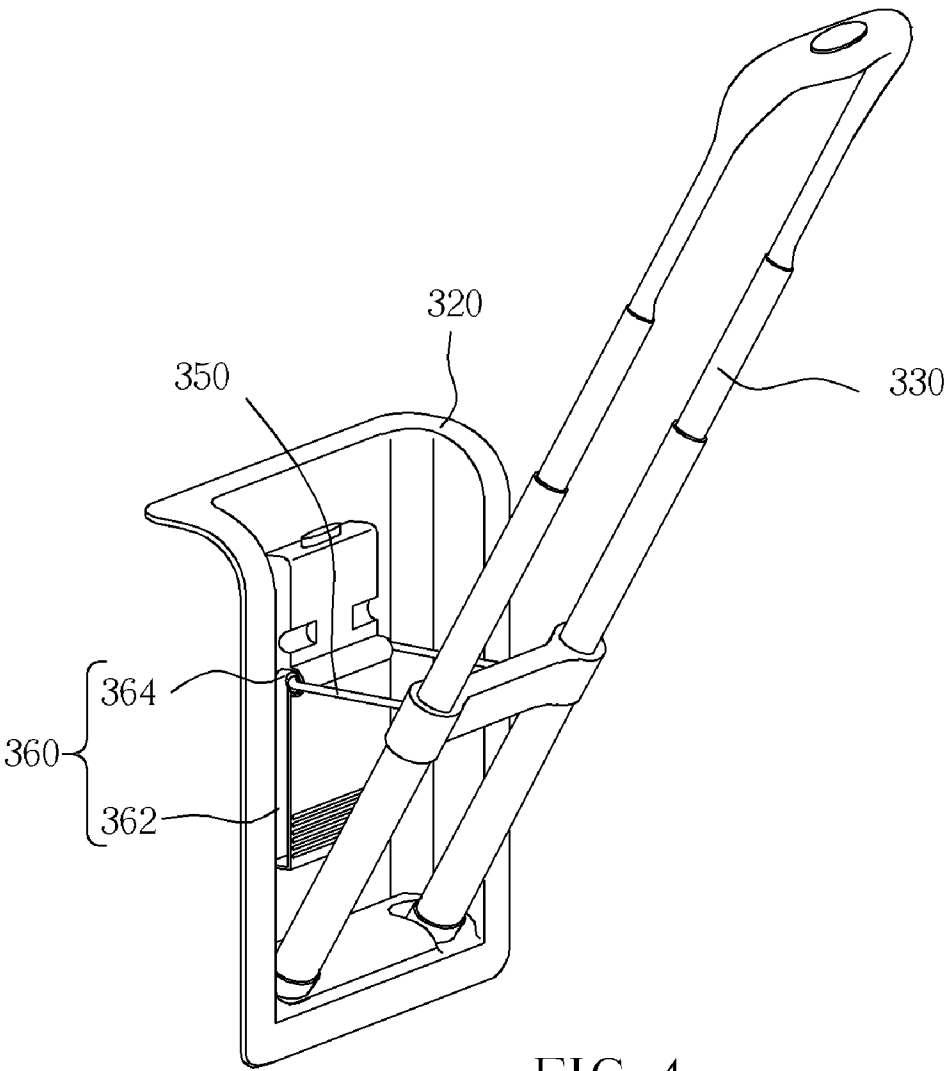
FIG. 4 is a perspective view of the slots and slide arms shown in FIG. 3.
Figure 5:
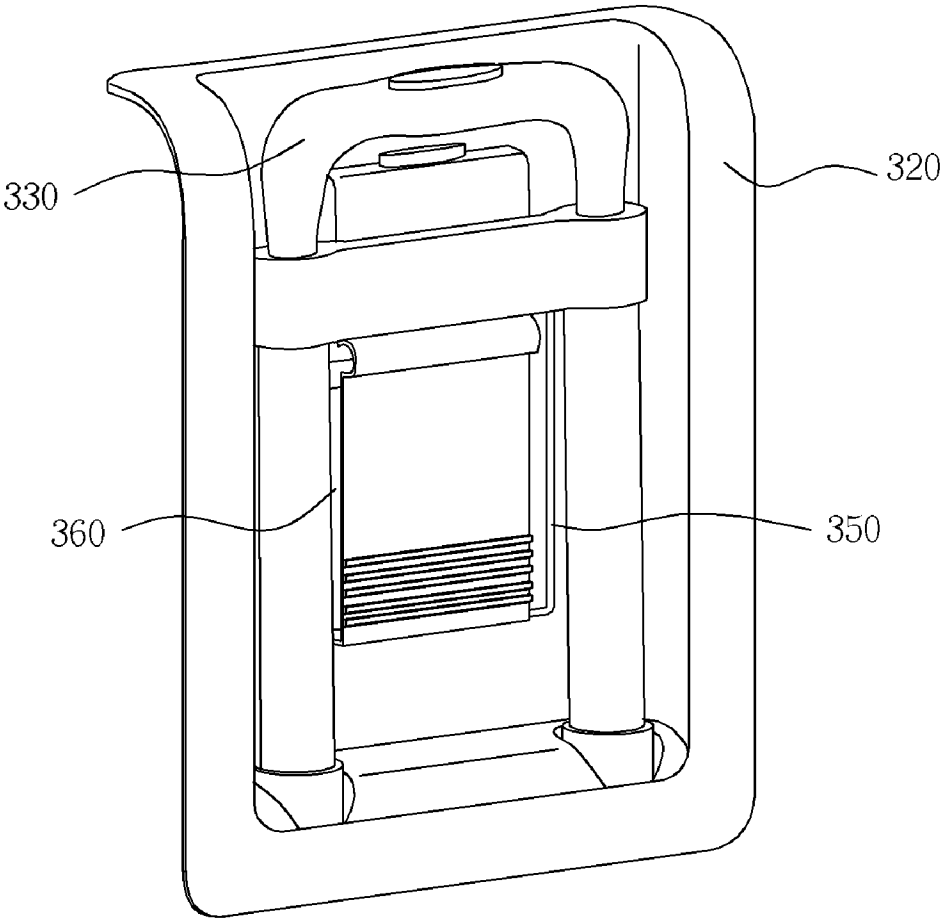
FIG. 5 illustrates an angularly retractable handle received by a mounting plate.
Figure 7:
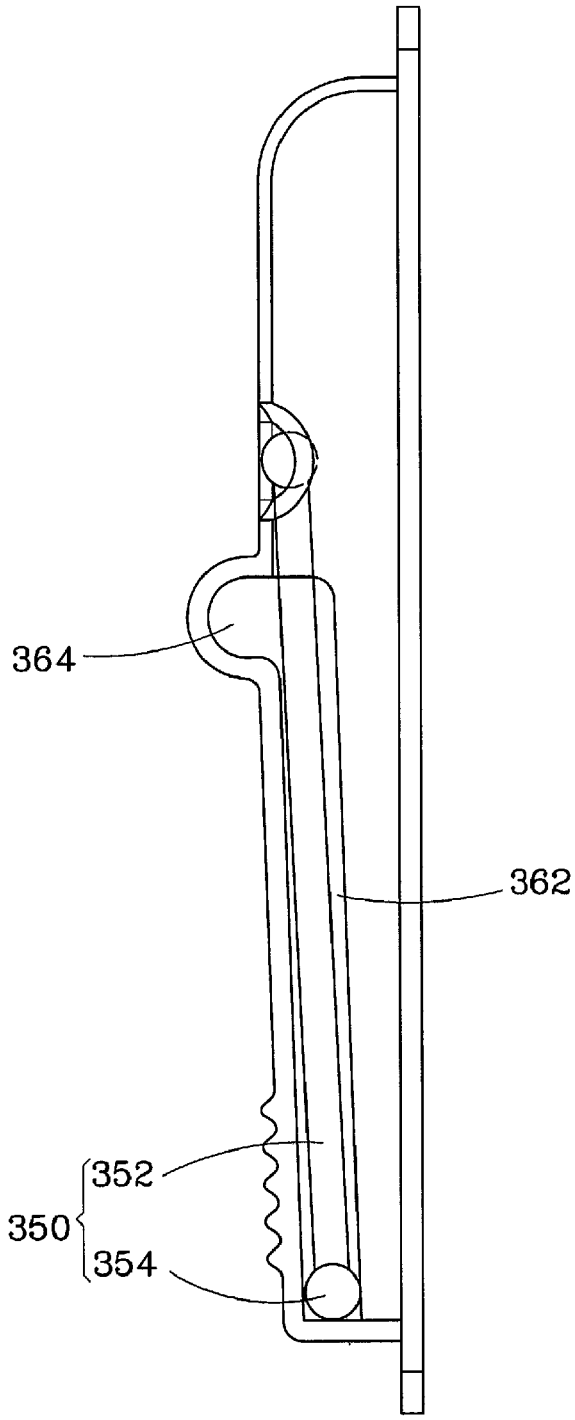
FIG. 7 is a side view of the slide arms and the slots when the angularly retractable handle is at the retaining position.

For clear illustration, please refer to FIG. 4. FIG. 4 is a perspective view of the slot 360 and the slide arm 350 shown in FIG. 3. As shown in FIG. 4, the slot 360 has a first portion 362 and a second portion 364. When the angularly retractable handle 330 is received in the mounting plate 320 as shown in FIG. 5, that is, when the angle between the angularly retractable handle 330 and the front wall 312 is nearly zero, the inner shaft portion 354 of the slide arm 350 is at the end of the first portion 362 of the slot 360. When the angularly retractable handle 330 rotates with respect to the front wall 312 of the main body 310 via the pivot 340, the inner shaft portion 354 of the slide arm 350 slides along the first portion 362 from the end of the first portion 362 toward the second portion 364. When the angularly retractable handle 330 is at the retaining position, that is, when the angle between the angularly retractable handle 330 and the front wall 312 is the target angle, the inner shaft portion 354 of the slide arm 350 is locked at the second portion 364. FIG. 6 is a side view of the slide arms 350 and the slots 360 when the angularly retractable handle 330 is received by the mounting plate 320. FIG. 7 is a side view of the slide arms 350 and the slots 360 when the angularly retractable handle 330 is at the retaining position.

Furthermore, the shape of the second portion 364 is like a notch to detent the slide arm 350 for retaining the angularly retractable handle 330 at the target angle with respect to the front wall 312. In addition, the outer shaft portion 352 of the slide arm 350 is fixed on the angularly retractable handle 330 in a rotational fashion to provide the support between the angularly retractable handle 330 and the main body 310.

Additionally, when the inner shaft portion 354 of the slide arm 350 is at the second portion 364, the outer shaft portion 352 of the slide arm 350 is parallel to the top wall 314 of the main body 310, allowing the user to put other baggage or object on it. And because the outer shaft portion 352 of the slide arm 350 has the function putting other baggage or object on it, the position of the pivot 340 is required to be designed according to this function of the slide arm 350.

Sometimes the user has other significantly large baggage and, in an embodiment shown in FIG. 3, a design of the target angle is provided to make the user put the baggage on top of the wheeled luggage 300 easily. When the angularly retractable handle 330 is rotated to the target angle with respect to the front wall 312 of the main body 310, on a horizontal plane of the top wall 314 of the main body 310, a horizontal distance between the angularly retractable handle 300 and the front wall 312 of the main body 310 is not less than a distance between the front wall and a rear wall 316 of the main body 310. Under the design mentioned above, the substantially large baggage can be put on the top wall 314 of the main body 310 and the edge of the baggage can be in the space between the angularly retractable handle 330 and the main body 310.

Figure 8:
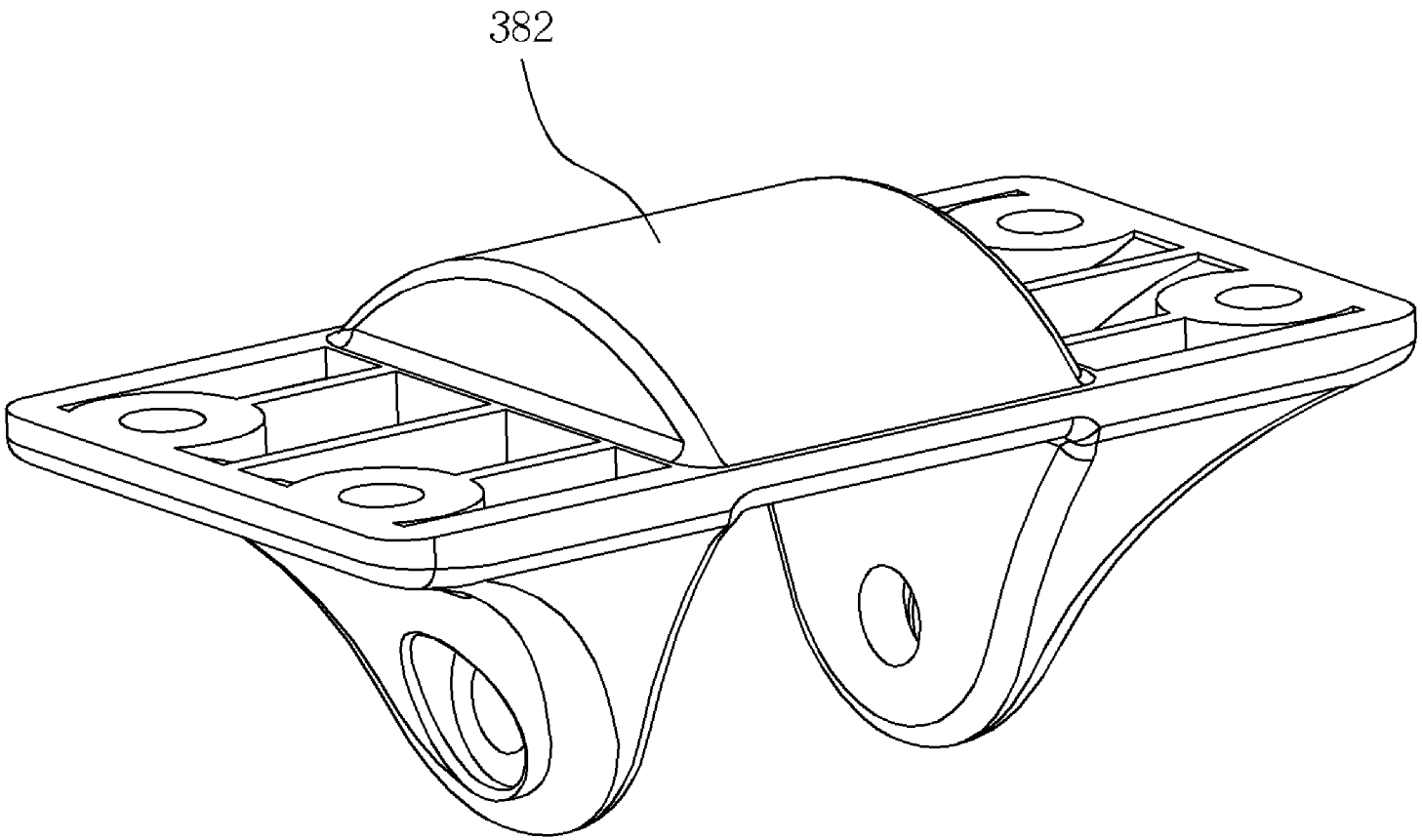
FIG. 8 is a perspective view of a fixed wheel carrier.
Figure 9:
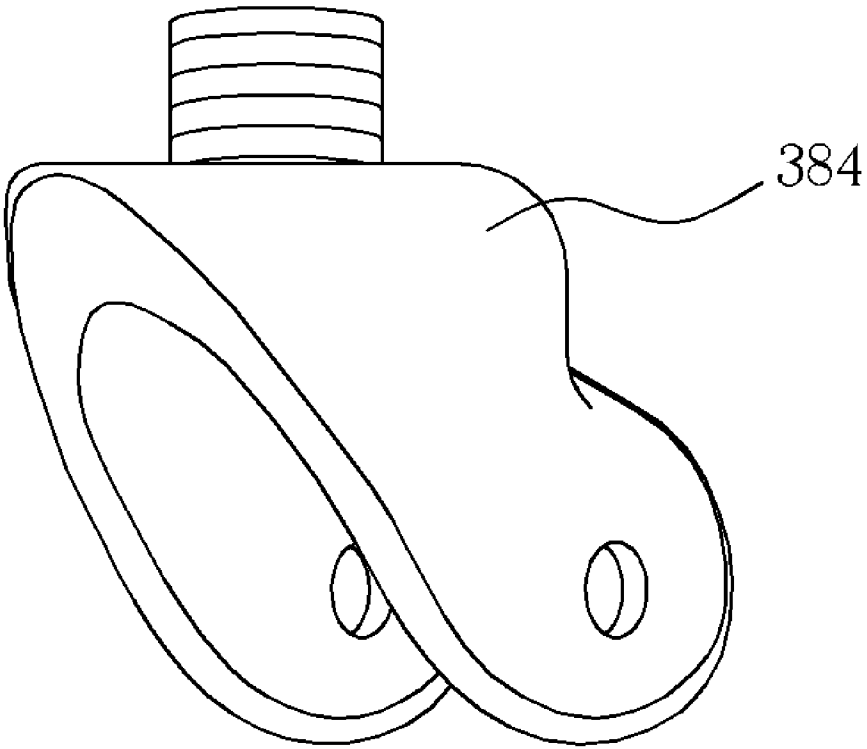
FIG. 9 is a perspective view of a rotatable wheel carrier allowing multi-directional rolling.
Figure 10:
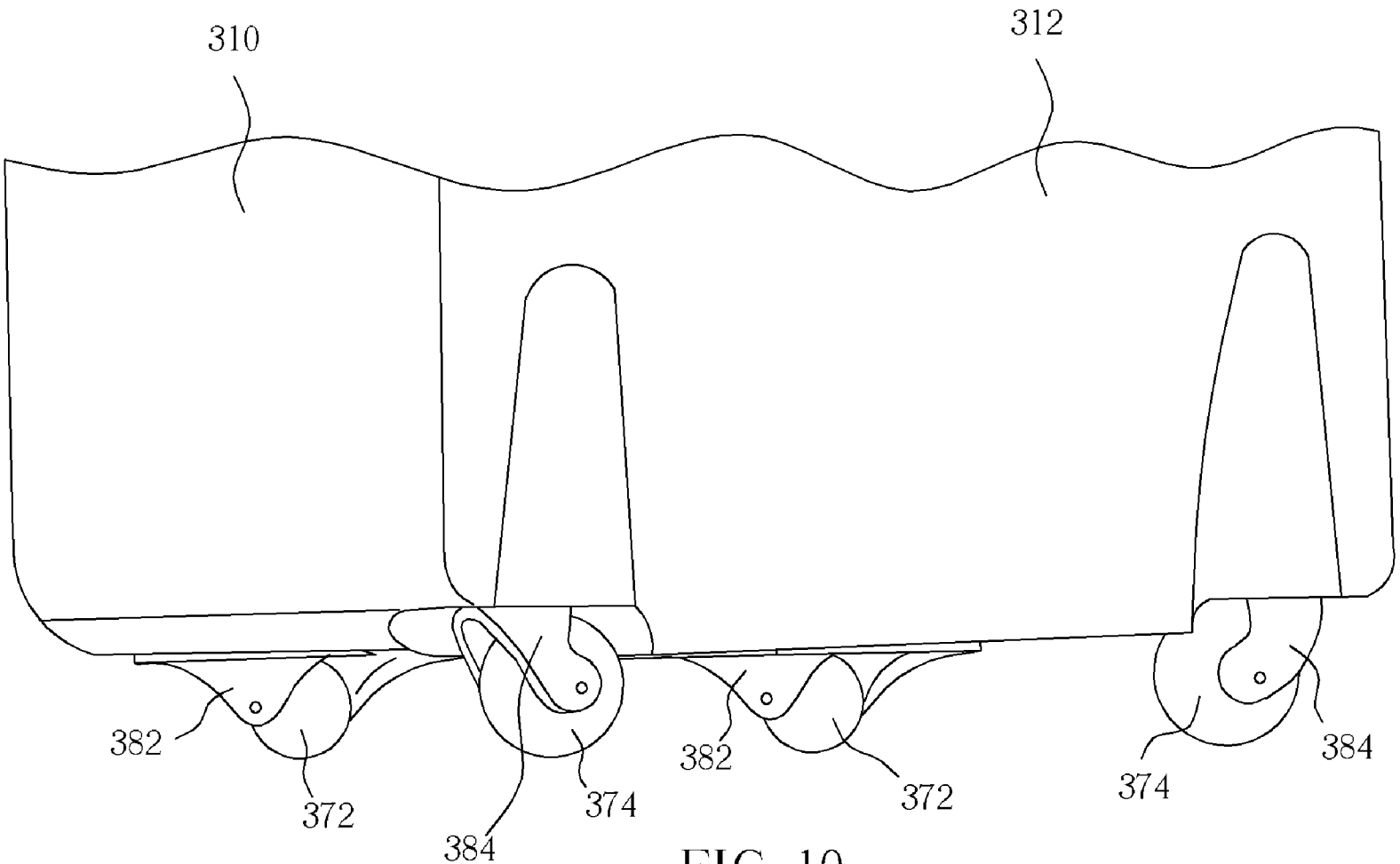
FIG. 10 is a perspective view of the fixed wheel carriers and the rotatable wheel carriers assembled on the main body.

Additionally, in prior art design of the luggage, wheels positioned at the bottom wall of the main body are assembled on wheel carriers which can rotate in 360 degrees, allowing multi-directional rolling. However, in the embodiment of the present invention, the wheels 372 close to the front wall 312 of the main body are assembled on the fixed wheel carriers 382, and the wheels 374 close to the front wall 316 of the main body 310 assembled on the rotatable wheel carriers 384. FIG. 8 is a perspective view of a fixed wheel carrier and FIG. 9 is a perspective view of a rotatable wheel carrier. In this embodiment, the moving direction of the wheels 372 assembled on the fixed wheel carriers 382 is parallel to the towing position of the luggage 300, and the moving direction of the wheels 374 assembled on the rotatable wheel carriers 384 can be any direction by the rotatable wheel carriers 384. According to the design of different wheel carriers positioned at the bottom wall 318 of the main body 310, the users can use less power to two the luggage 300 or to change the moving direction. FIG. 10 is a perspective view of the fixed wheel carriers 382 and the rotatable wheel carriers 384 assembled on the main body 310.

Briefly summarized, designs of the position of the pivot, the target angle between the angularly retractable handle 330 and the main body 310, and the slide arm 350 serving as a supporting device according to the embodiment of the present invention provides the additional space on the top wall 314 of the main body 310 and lets the user tow the wheeled luggage with less energy exerted.

Those skilled in the art will readily observe that numerous modifications and alterations of the device and method may be made while retaining the teachings of the invention.

What is claimed is:

1. Luggage, comprising:

a main body;

a mounting plate, positioned at a front wall of the main body;

a pivot, positioned at the mounting plate;

an angularly retractable handle, connected to the mounting plate by the pivot, wherein the angularly retractable handle rotates with respect to the front wall of the main body via the pivot;

a plurality of first wheel carriers, fixedly positioned on a bottom wall of the main body;

a plurality of second wheel carriers, positioned on a bottom wall of the main body in a rotatable way allowing multi-directional rolling;

at least four wheels, respectively assembled on the plurality of first wheel carriers and the plurality of second wheel carriers;

a slide arm, for movably connecting the mounting plate and the angularly retractable handle to maintain a target angle between the angularly retractable handle and the front wall of the main body; and a slot, formed in the mounting plate, for guiding the slide arm to slide thereon, the slot having a first portion and a second portion extending at an angle with respect to the first portion, the second portion including a notch;

wherein the slide arm has two outer shaft portions and one inner shaft portion, each outer shaft portion has a first end and a second end and connects to the angularly retractable handle with the first end, and the inner shaft portion is positioned in the slot and connects the second ends of the outer shaft portions, wherein the slot is positioned between the second ends of the outer shaft portions, and the inner shaft portion is locked in the notch of the second portion of the slot when the retractable handle is at the target angle.

2. The luggage of claim 1, wherein the slot has a first portion and a second portion having a predetermined angle with respect to the first portion; when the slide arm moves to the second portion, the target angle is maintained between the angularly retractable handle and the front wall of the main body; and when the slide arm moves on the first portion, an angle between the angularly retractable handle and the front wall of the main body is smaller than the target angle.

3. The luggage of claim 1, wherein the plurality of first wheel carriers and the plurality of second wheel carriers are respectively positioned at the two opposite sides of the bottom wall of the main body.

4. Luggage, comprising:

a main body;

a mounting plate, positioned at a front wall of the main body;

a pivot, positioned at the mounting wall;

an angularly retractable handle, connected to the mounting plate by the pivot, wherein the angularly retractable handle rotates with respect to the front wall of the main body via the pivot;

a slide arm, for movably connecting the mounting plate and the angularly retractable handle to maintain a target angle between the angularly retractable handle and the front wall of the main body; and a slot, formed in the mounting plate, for guiding the slide arm to slide thereon, the slot having a first portion and a second portion extending at an angle with respect to the first portion, the second portion including a notch;

wherein the slide arm has two outer shaft portions and one inner shaft portion, each outer shaft portion has a first end and a second end and connects to the angularly retractable handle with the first end, and the inner shaft portion is positioned in the slot and connects the second ends of the outer shaft portions, wherein the slot is positioned between the second ends of the outer shaft portions, and the inner shaft portion is locked in the notch of the second portion of the slot when the retractable handle is at the target angle.

5. The luggage of claim 4, wherein the slot has a first portion and a second portion having a predetermined angle with respect to the first portion; when the slide arm moves to the second portion, the target angle is maintained between the angularly retractable handle and the front wall of the main body; and when the slide arm moves to the first portion, an angle between the angularly retractable handle and the front wall of the main body is smaller than the target angle.

* * * * *